US010443330B2

(12) United States Patent
Jacob

(10) Patent No.: US 10,443,330 B2
(45) Date of Patent: Oct. 15, 2019

(54) DEPLOYING AN EXPANDABLE DOWNHOLE SEAT ASSEMBLY

(71) Applicant: Schlumberger Technology Corporation, Sugar Land, TX (US)

(72) Inventor: Gregoire Jacob, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 495 days.

(21) Appl. No.: 15/102,246

(22) PCT Filed: Oct. 1, 2014

(86) PCT No.: PCT/US2014/058522
§ 371 (c)(1),
(2) Date: Jun. 6, 2016

(87) PCT Pub. No.: WO2015/084479
PCT Pub. Date: Jun. 11, 2015

(65) Prior Publication Data

US 2016/0305208 A1 Oct. 20, 2016

Related U.S. Application Data

(60) Provisional application No. 61/912,660, filed on Dec. 6, 2013.

(51) Int. Cl.

| | |
|---|---|
| ***E21B 23/01*** | (2006.01) |
| ***E21B 33/12*** | (2006.01) |
| ***E21B 34/14*** | (2006.01) |
| *E21B 43/26* | (2006.01) |

(52) U.S. Cl.
CPC ..... *E21B 23/01* (2013.01); *E21B 33/12* (2013.01); *E21B 34/14* (2013.01); *E21B 43/26* (2013.01)

(58) Field of Classification Search
CPC ..... E21B 34/14; E21B 43/105; E21B 43/103; E21B 33/12; E21B 23/01; E21B 43/26
See application file for complete search history.

(56) References Cited

U.S. PATENT DOCUMENTS

| | | | | |
|---|---|---|---|---|
| 4,311,196 A * | 1/1982 | Beall | E21B 33/129 166/134 |
| 6,155,350 A | 12/2000 | Melenyzer | |
| 7,114,559 B2 * | 10/2006 | Sonnier | E21B 4/18 166/206 |
| 7,128,146 B2 * | 10/2006 | Baugh | E21B 43/105 166/206 |

(Continued)

OTHER PUBLICATIONS

Search Report and Written Opinion for corresponding International Patent Application Serial No. PCT/US2014/058522 dated Jan. 27, 2015, 9 pages.

(Continued)

*Primary Examiner* — Daniel P Stephenson

(57) ABSTRACT

A method includes deploying an assembly in a contracted state on a tool into a well. The assembly includes segments that are adapted to be radially contracted in the contracted state. The method further includes expanding the assembly downhole in the well using the tool to transition the assembly between the contracted state and an expanded state. Expanding the assembly includes using linkages to guide the segments during the expansion.

19 Claims, 15 Drawing Sheets

(56) References Cited

U.S. PATENT DOCUMENTS

| | | | | |
|---|---|---|---|---|
| 7,549,469 | B2 * | 6/2009 | Garcia | E21B 43/105 166/206 |
| 7,669,665 | B2 | 3/2010 | Millet et al. | |
| 7,775,279 | B2 | 8/2010 | Marya et al. | |
| 8,069,916 | B2 * | 12/2011 | Giroux | E21B 7/20 166/212 |
| 8,211,247 | B2 | 7/2012 | Marya et al. | |
| 9,085,967 | B2 * | 7/2015 | Bennett | E21B 43/105 |
| 9,528,336 | B2 * | 12/2016 | Jacob | E21B 23/00 |
| 9,644,452 | B2 * | 5/2017 | Jacob | E21B 34/063 |
| 9,752,407 | B2 * | 9/2017 | Jacob | E21B 33/129 |
| 9,988,867 | B2 * | 6/2018 | Jacob | E21B 23/00 |
| 2007/0131413 | A1 * | 6/2007 | Millet | E21B 33/1216 166/115 |
| 2007/0277971 | A1 * | 12/2007 | Garcia | E21B 43/105 166/206 |
| 2009/0159289 | A1 | 6/2009 | Avant et al. | |
| 2011/0259610 | A1 | 10/2011 | Shkurti et al. | |
| 2012/0145378 | A1 | 6/2012 | Frazier | |
| 2013/0062063 | A1 | 3/2013 | Baihly et al. | |
| 2014/0216759 | A1 * | 8/2014 | Jacob | E21B 23/00 166/382 |
| 2015/0075816 | A1 | 3/2015 | Jacob | |
| 2015/0176361 | A1 * | 6/2015 | Prosser | E21B 34/14 166/192 |
| 2016/0305208 | A1 * | 10/2016 | Jacob | E21B 34/14 |
| 2016/0326820 | A1 * | 11/2016 | Pacey | E21B 23/04 |

OTHER PUBLICATIONS

Australian Examination Report for corresponding Australian Application Serial No. 2014357648, dated Feb. 2, 2018, 5 pages.

* cited by examiner

DEPLOYING AN EXPANDABLE DOWNHOLE SEAT ASSEMBLY

BACKGROUND

For purposes of preparing a well for the production of oil or gas, at least one perforating gun may be deployed into the well via a conveyance mechanism, such as a wireline, slickline or a coiled tubing string. The shaped charges of the perforating gun(s) are fired when the gun(s) are appropriately positioned to perforate a tubing of the well and form perforating tunnels into the surrounding formation. Additional operations may be performed in the well to increase the well's permeability, such as well stimulation operations and operations that involve hydraulic fracturing. The above-described perforating and stimulation operations may be performed in multiple stages of the well.

The above-described operations may be performed by actuating one or more downhole tools (perforating guns, sleeve valves, and so forth). A given downhole tool may be actuated using a wide variety of techniques, such dropping a ball into the well sized for a seat of the tool; running another tool into the well on a conveyance mechanism to mechanically shift or inductively communicate with the tool to be actuated; pressurizing a control line; and so forth.

SUMMARY

In an example implementation, a method includes deploying an assembly in a contracted state on a tool into a well. The assembly includes segments that are adapted to be radially contracted in the contracted state. The method further includes expanding the assembly downhole in the well using the tool to transition the assembly between the contracted state and an expanded state. Expanding the assembly includes using linkages to guide the segments during the expansion.

In another example implementation, a method that is usable with a well includes a segmented assembly; a setting tool and linkages. The segmented assembly includes segments and has a contracted state and an expanded state. The setting tool is adapted to be run downhole with the assembly as a unit with the assembly being in the contracted state and be used to transition the assembly to the expanded state. The linkages guide the segments during the transition of the assembly to the expanded state.

In yet another example implementation, an apparatus that is usable with a well includes a segmented assembly; a setting tool; and springs. The segmented seat assembly includes segments and has a contracted state and an expanded state to form a seat. The setting tool is adapted to be run downhole with the seat assembly as a unit with the seat assembly being in the contracted state and be used to transition the seat assembly to the expanded state to form a seat. The springs guide the segments during the transition of the assembly to the expanded state Advantages and other features will become apparent from the following drawing, description and claims.

DETAILED DESCRIPTION

In general, systems and techniques are disclosed herein to deploy and use a seat assembly in a well for purposes of performing a downhole operation. In this regard, the seat assembly that is disclosed herein may be run downhole in the well in a passageway of a tubing string that was previously installed in the well and be secured to the tubing string at a desired location in which a downhole operation is to be performed. The downhole operation may be any of a number of operations (stimulation operations, perforating operations, and so forth) that rely on an object being landed in a seat of the seat assembly.

In general, the seat assembly is an expandable, segmented assembly, which has two states: a collapsed, or unexpanded state, which allows the seat assembly to have a smaller cross-section for purposes of running the assembly downhole inside a tubing string to a targeted downhole location; and an expanded state in which the seat assembly forms a continuously extending seat (a ring, for example) that is constructed to catch an object that is deployed in the string for purposes of forming a downhole fluid obstruction, or barrier. In accordance with example implementations, in its expanded state, the seat assembly is constructed to receive, or catch, an untethered object, which is deployed in the passageway of the tubing string. In this context, the "untethered object" refers to an object that is communicated downhole through the passageway of the string along at least part of its path without the use of a conveyance line (a slickline, a wireline, a coiled tubing string and so forth). As examples, the untethered object may be a ball (or sphere), a dart or a bar.

In accordance with example implementations, the seat assembly contains multiple curved sections, or segments, that are constructed to radially contract and axially expand into multiple layers to form the contracted state of the seat assembly; and the sections are constructed to radially expand and axially contract into a single layer to form an object catching seat in the expanded state of the seat assembly. A setting tool may be used to contact the segments of the seat assembly for purposes of transitioning the seat assembly between the expanded and contracted states, as further described herein. Moreover, as described herein, in accordance with example implementations, for purposes of guiding the segments of the seat assembly into position during the setting of the seat assembly and aiding the application of axial and radial forces on the segments, the segments may either be linked together or linked to the setting tool.

Figure 1:
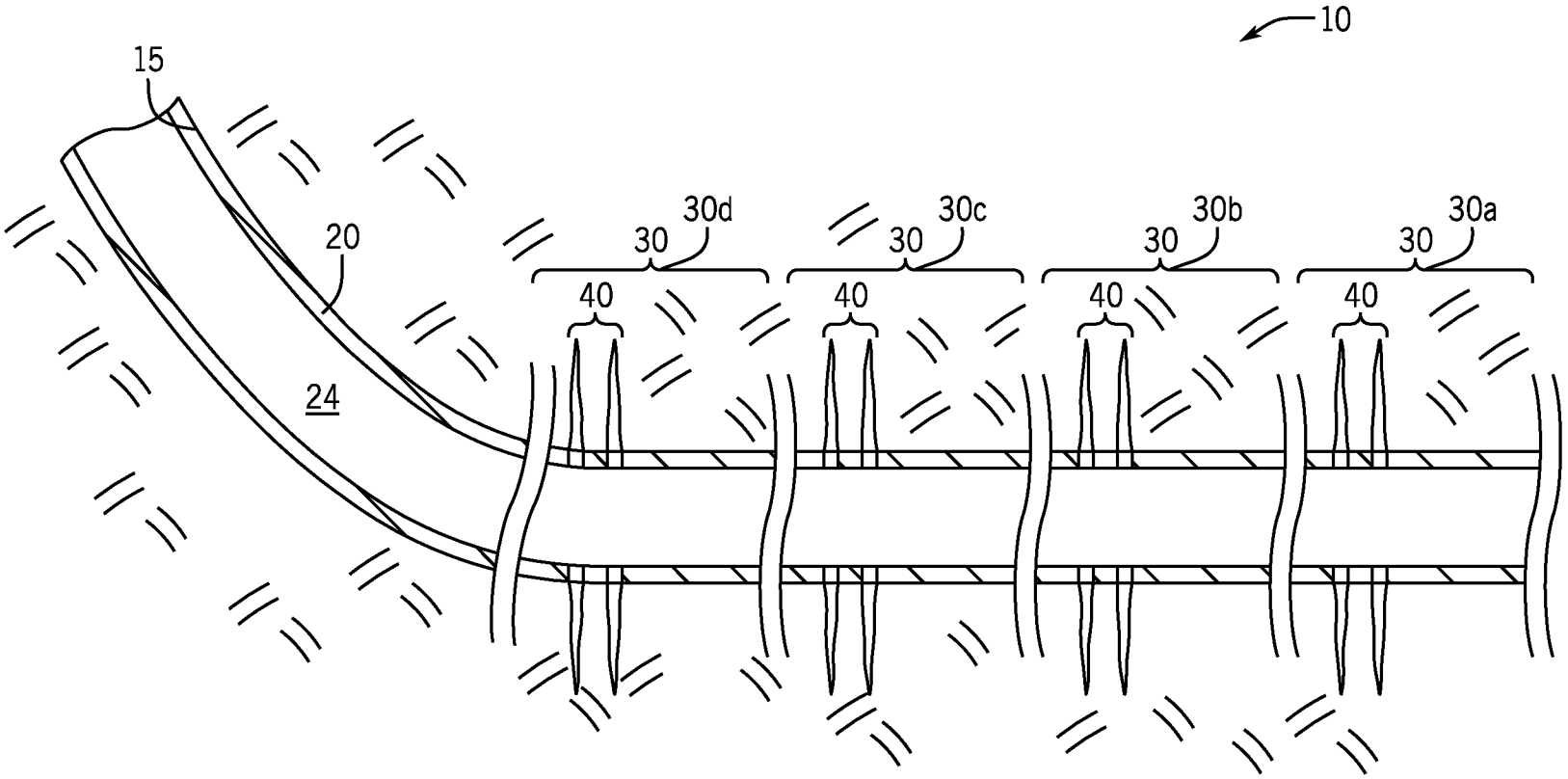
FIGS. 1 and 2 are schematic diagrams of wells according to example implementations.

As a more specific example, in accordance with some implementations, a well 10 includes a wellbore 15, which traverses one or more hydrocarbon-bearing formations. As an example, the wellbore 15 may be lined, or supported, by a tubing string 20, as depicted in FIG. 1. The tubing string 20 may be cemented to the wellbore 15 (such wellbores are typically referred to as "cased hole" wellbores); or the tubing string 20 may be secured to the surrounding formation(s) by packers (such wellbores typically are referred to as "open hole" wellbores). In general, the wellbore 15 may extend through multiple zones, or stages 30 (four example stages 30*a*, 30*b*, 30*c* and 30*d*, being depicted in FIG. 1, as examples), of the well 10.

It is noted that although FIG. 1 and other figures disclosed herein depict a lateral wellbore, the techniques and systems that are disclosed herein may likewise be applied to vertical wellbores. Moreover, in accordance with some implementations, the well 10 may contain multiple wellbores, which contain tubing strings that are similar to the illustrated tubing string 20 of FIG. 1. The well 10 may be a subsea well or may be a terrestrial well, depending on the particular implementations. Additionally, the well 10 may be an injection well or may be a production well. Thus, many implementations are contemplated, which are within the scope of the appended claims.

Downhole operations may be performed in the stages 30 in a particular directional order, in accordance with example implementations. For example, in accordance with some implementations, downhole operations may be conducted in a direction from a toe end of the wellbore to a heel end of the wellbore 15. In further implementations, these downhole operations may be conducted from the heel end to the toe end of the wellbore 15. In accordance with further example implementations, the operations may be performed in no particular order, or sequence.

FIG. 1 depicts that fluid communication with the surrounding hydrocarbon formation(s) has been enhanced through sets 40 of perforation tunnels that, for this example, are formed in each stage 30 and extend through the tubing string 20. It is noted that each stage 30 may have multiple sets of such perforation tunnels 40. Although perforation tunnels 40 are depicted in FIG. 1, it is understood that other techniques may be used to establish/enhance fluid communication with the surrounding formation (s), as the fluid communication may be alternatively established using, for example, a jetting tool that communicates an abrasive slurry to perforate the tubing string wall; opening sleeve valves of the tubing string 20; and so forth. Moreover the tubing string 20 may contain sleeve valves that are selectively shifted open to establish communication with the surrounding formation, such as the system described in, for example, U.S. patent application Ser. No. 14/269,304, entitled, "SEGMENTED RING ASSEMBLY," which was filed on May 5, 2014, and is hereby incorporated by reference.

Figure 2:
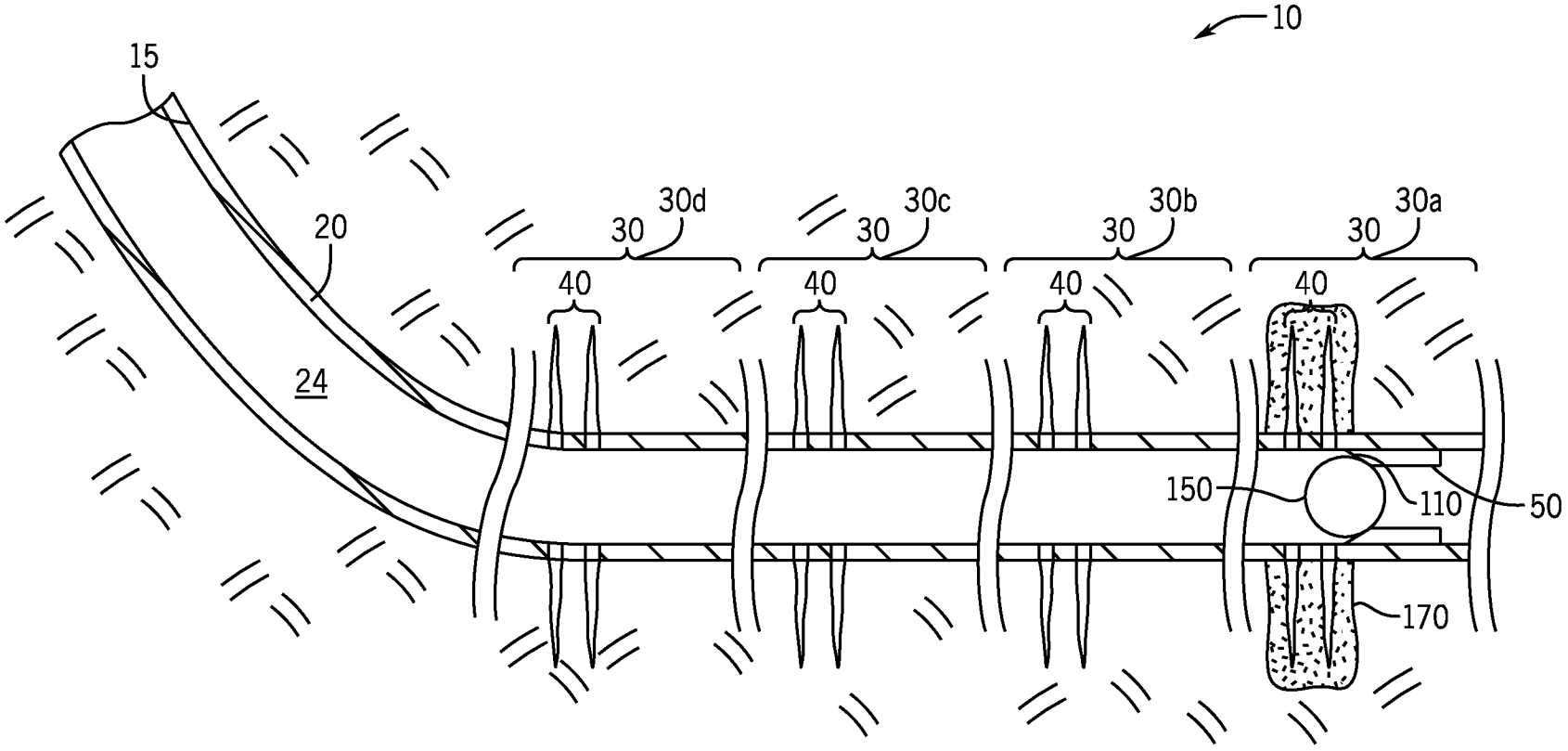

Referring to FIG. 2 in conjunction with FIG. 1, as an example, a stimulation operation may be performed in the stage 30*a* by deploying an expandable, segmented seat assembly 50 (also referred to herein as the "seat assembly 50") into the tubing string 20 on a setting tool (as further disclosed herein) in a contracted state of the assembly 50; expanding the seat assembly 50 downhole in the well; and securing the seat assembly 50 to the tubing string 20 at a targeted location in the stage 30*a*. For the example implementation that is depicted in FIG. 2, the seat assembly 50 is installed in the tubing string 20 near the bottom, or downhole end, of the stage 30*a*. Once installed inside the tubing string 20, the combination of the seat assembly 50, and an untethered object (here, an activation ball 150) form a fluid tight obstruction, or barrier, to divert fluid in the tubing string 20 uphole of the barrier. Thus, for the example implementation of FIG. 2, the fluid barrier may be used to direct fracturing fluid (pumped into the tubing string 20 from the Earth surface) into the stage 30*a*.

In accordance with further example implementations, the untethered object may be part of a tool string, as described in U.S. patent application Ser. No. 14/269,304.

In accordance with example implementations, a segmented seat assembly may be run downhole on a setting tool which, when the seat assembly is at the appropriate position, may be actuated to concurrently radially expand the segments of the seat assembly and longitudinally contract the layers of the seat assembly. More specifically, in accordance with example implementations, the setting tool may be used downhole in the well to produce radial and axial forces that are exerted on the segments of the seat assembly for purposes of expanding the seat assembly.

Figure 3:
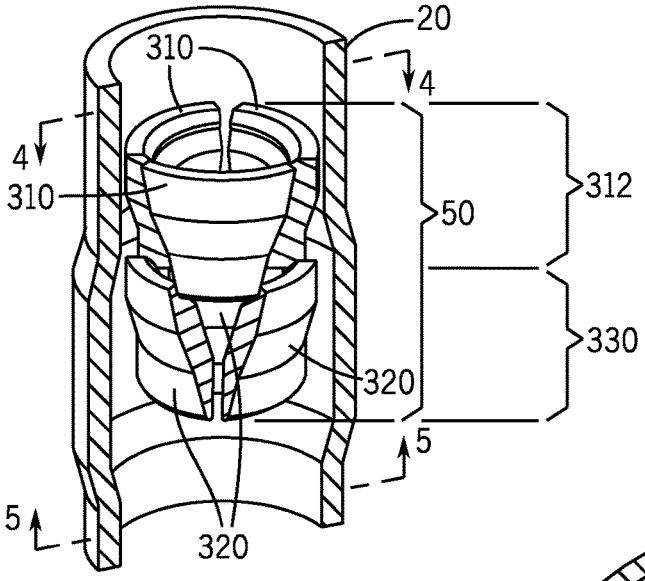
FIG. 3 is a schematic view illustrating an expandable, segmented seat assembly in a contracted state and inside a tubing string according to an example implementation.
Figure 4:
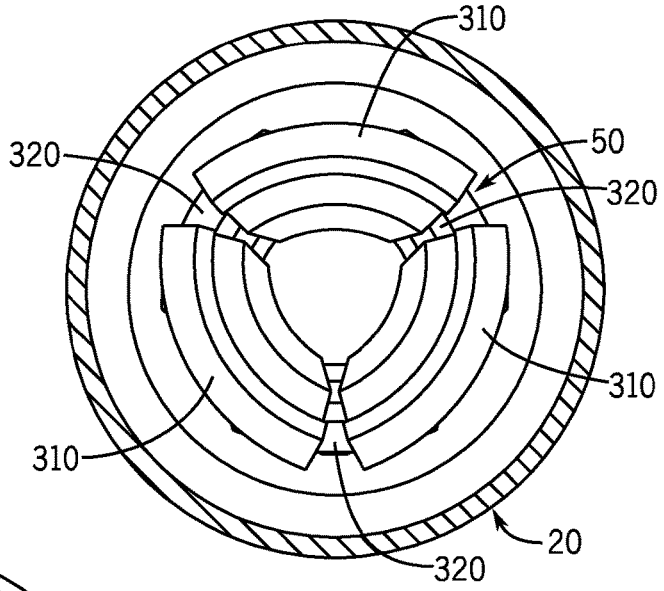
FIG. 4 is a cross-sectional view taken along line 4-4 of FIG. 3 according to an example implementation.
Figure 5:
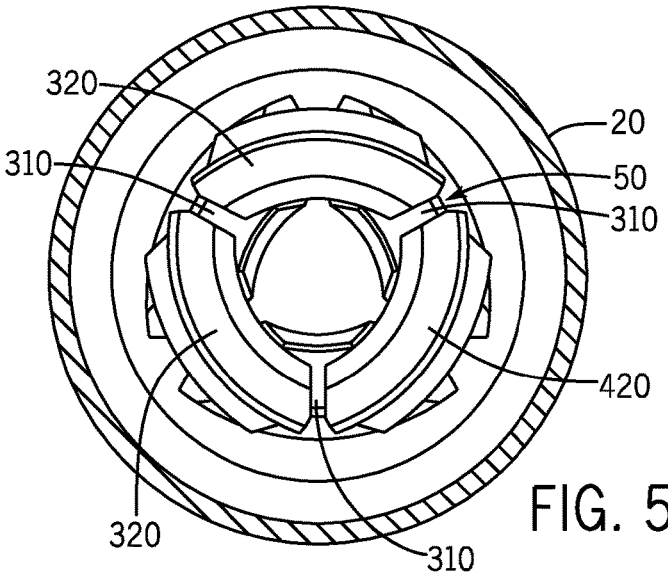
FIG. 5 is a cross-sectional view taken along line 5-5 of FIG. 3 according to an example implementation.

As an example, FIG. 3 is a perspective of the seat assembly 50, and FIGS. 4 and 5 illustrate cross-sectional views of the seat assembly 50 of FIG. 3, in accordance with an example implementation. Referring to FIG. 3, this figure depicts the seat assembly 50 in a contracted state, i.e., in a state in which the seat assembly 50 has an overall reduced cross-sectional diameter for purposes of facilitating travel of the seat assembly 50 downhole to its final position. The seat assembly, 50 for this example implementation has two sets of arcuate segments: three upper segments 310; and three lower segments 320. In the contracted state, the segments 310 and 320 are radially contracted (with respect to the assembly's longitudinal axis) and are longitudinally, or axially, expanded (with respect to the assembly's longitudinal axis) into two layers 312 and 330.

Figure 6:
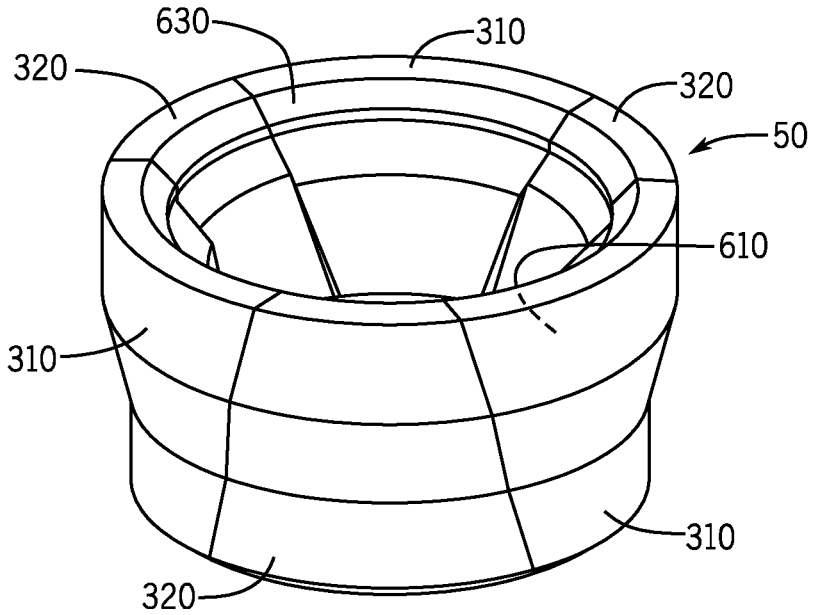
FIG. 6 is a perspective view of the seat assembly in an expanded state according to an example implementation.

The upper segment 310 is, in general, a curved wedge that has a radius of curvature about the longitudinal axis of the seat assembly 50 and is larger at its top end than at its bottom end; and the lower segment 320 is, in general, an curved wedge that has the same radius of curvature about the longitudinal axis (as the upper segment) and is larger at its bottom end than at its top end. Due to the relative complementary profiles of the segments 310 and 320, when the seat assembly 50 expands (i.e., when the segments 310 and 320 radially expand and the segments 310 and 320 axially contract), the two layers 312 and 330 longitudinally, or axially, compress into a single layer of segments such that each upper segment 310 is complimentarily received between two lower segments 320, and vice versa, as depicted in FIG. 6. In its expanded state, the seat assembly 50 forms a tubular member having a seat that is sized to catch an appropriately-sized object that is deployed in the tubing string 20 (from the Earth surface, for example) or deployed otherwise for purposes of forming a fluid barrier.

Figure 7:
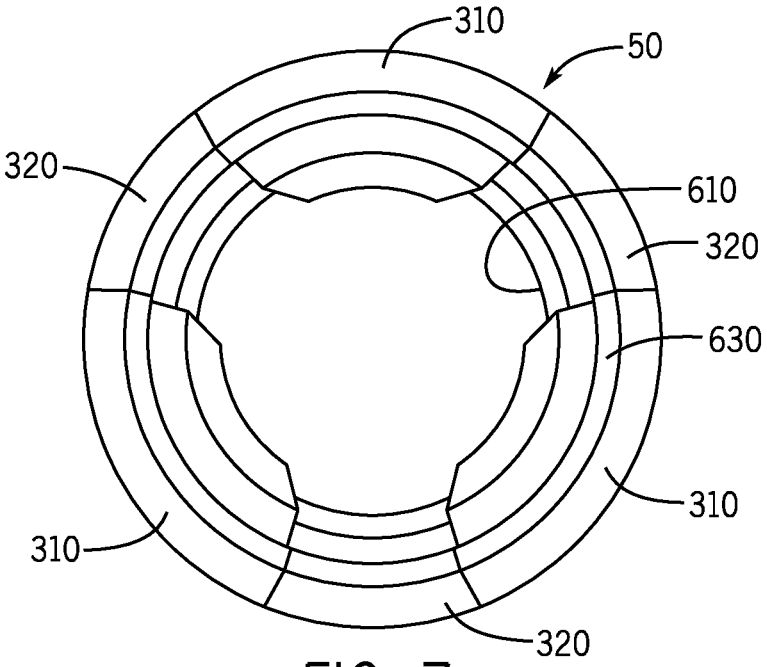
FIG. 7 is a top view of the seat assembly of FIG. 6 according to an example implementation.

More specifically, an upper curved surface of each of the segments 310 and 320 forms a corresponding section of a continuous seat ring 630 (i.e., the "seat") of the seat assembly 50 when the assembly 50 is in its expanded state. As depicted in FIG. 7, in accordance with example implementations, for the expanded state of the seat assembly 50, the seat ring 630 of the seat assembly 50 defines an opening 610, which is appropriately sized to control which smaller size objects pass through the seat assembly (i.e., pass through the seat ring 630) and which larger size objects are caught by the seat assembly 50 (i.e., are caught by the seat ring 630).

In accordance with example implementations, a segmented seat assembly is run into the well in and set (i.e., transitioned into the expanded state) using a setting tool. For purposes of guiding the travel of the seat segments when setting the seat assembly so that the segments move to the appropriate positions and to aid application of radial and axis expansion forces to the segments, the segments may either linked together or the segments may be linked to the setting tool, as discussed in example implementations herein.

Figure 8B:
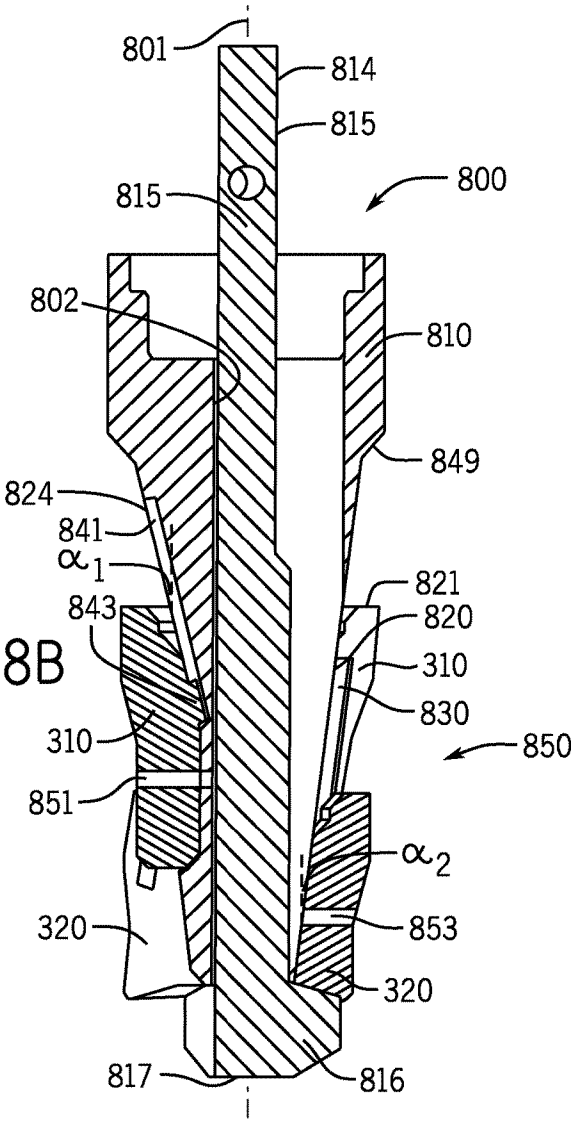
FIG. 8B is a cross-sectional view taken along line 8B-8B of FIG. 8A according to an example implementation.
Figure 8A:
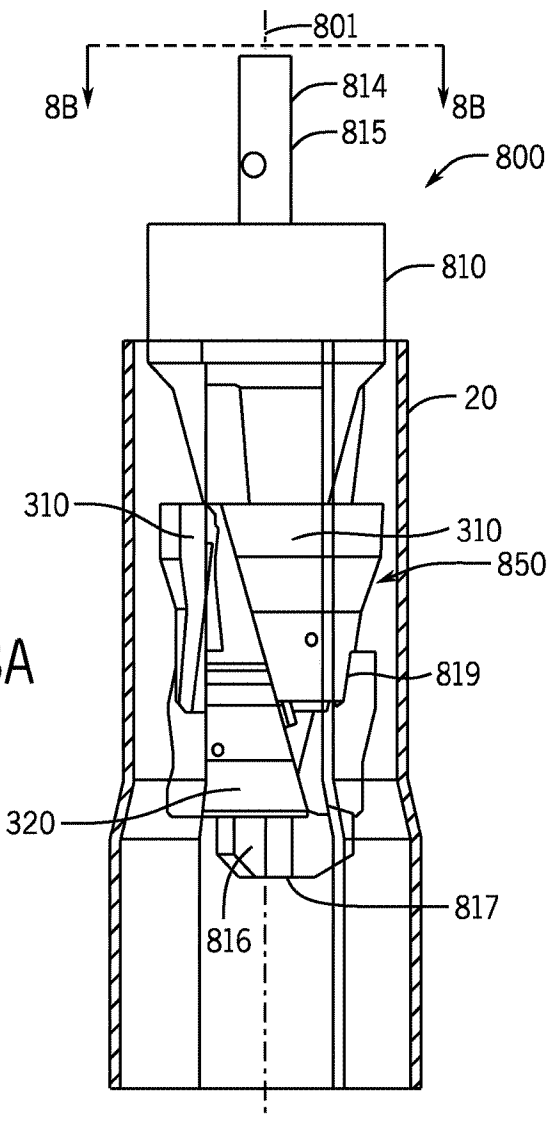
FIG. 8A is a perspective schematic view of a segmented seat assembly that has interlinked seat segments and a setting tool illustrating running of the seat assembly into a tubular string in the well according to an example implementation.

FIG. 8A depicts the running of a setting tool 800 and a segmented seat assembly 850 downhole in the tubing string 20, in accordance with an example implementation in which upper 310 and lower 320 segments of the assembly 850 are linked together. FIG. 8A depicts the seat assembly 850 is in its contracted, run-in-hole state.

In general, the setting tool 800 and segmented seat assembly 850 may be run downhole as a unit on a conveyance mechanism. In this manner, the segmented seat assembly 850 may be secured to the setting tool 800, and the upper end of the setting tool 800 may be attached to a conveyance mechanism, such as a tubing string, a slickline or a wireline, depending on the particular implementation.

The setting tool 800, for this example implementation, includes a double cone assembly 810, which is attached to a tool string (a conveyance string, such as a wireline, slickline, coiled tubing, and so forth) that is used to run the setting tool 800 and segmented seat assembly 850 into the well. In this manner, the tool string is positioned for purposes of positioning and stopping the setting tool 800 and segmented seat assembly 850 at the desired, targeted downhole location where the seat assembly 850 is to be set (i.e., radially expanded). The setting tool 800 further includes a movable mandrel 815, which extends through the cone assembly 810 and includes an upper end 814 and a lower end 817. In this manner, as depicted in FIG. 8A, the mandrel 815 extends through a central passageway 802 of the cone assembly 810, and the lower end 817 of the mandrel 815 has radially extending protrusions 816 that engage the lower segments 320 of the segmented seat assembly 850.

The cone assembly 810 has outer upper 824 and lower 820 conical surfaces that are used to engage the lower 320 and upper 310 seat segments, respectively, for purposes of expanding the seat assembly 850. Referring also to FIG. 8B, more specifically, when the mandrel 815 is pulled in an upper direction relative to the cone assembly 810, the lower shoulders 816 of the mandrel 815 engage and exert upward forces on the lower seat segments 320. In accordance with some implementations, when the upward forces exceed a threshold, shear pins shear (such as a shear pin in a groove 851 that extends through the upper seat segment 310 and into an opening in the cone assembly 810 and/or a shear pin in a groove 853 that extends through the lower seat segment 320, as examples) to release the seat segments 320 from the cone assembly 810 and allow the seat segments 320 to move upwardly with the mandrel 815. In this manner, due to engagement of the lower segments 320 with the lower conical surface 820 of the cone assembly 810, the upward movement of the lower seat segments 320 causes the segments 320 to radially expand.

Figure 8C:
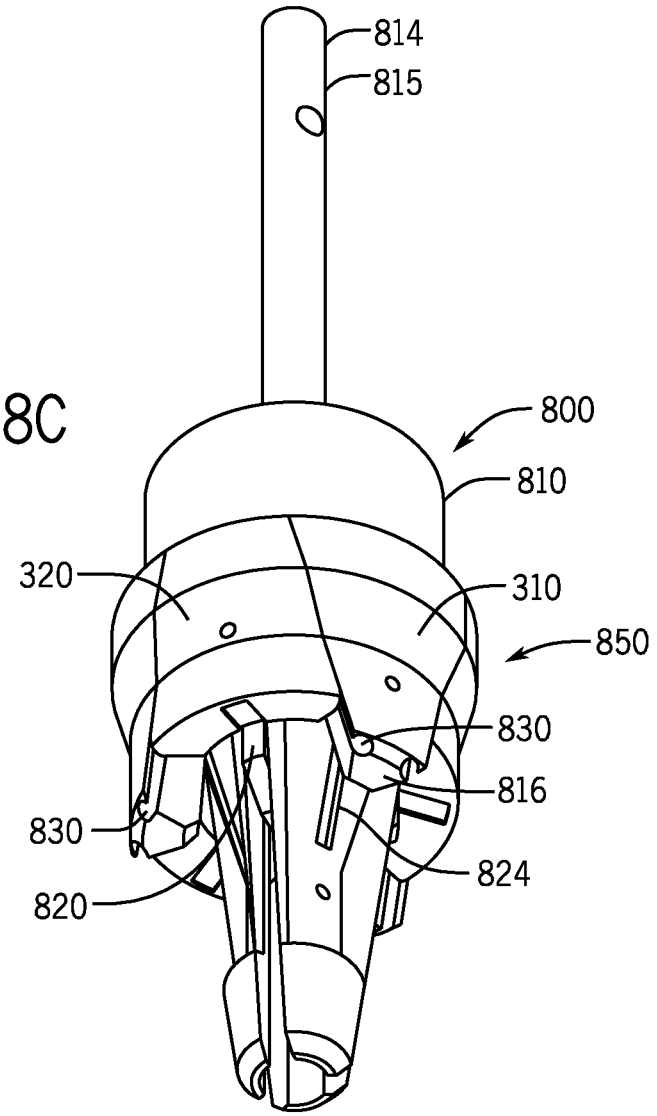
FIG. 8C is a perspective view illustrating use of the setting tool to set the seat assembly according to an example implementation.

The upward movement of the lower seat segments 320 causes the upper seat segments 310 to move; and due to engagement of the upper seat segments 310 with the upper conical surface 820, the upper seat segments 310 are also directed in a radially outward direction as the mandrel 815 moves upwardly. As depicted in FIG. 8B, one or more of the seat segments 310 and 320 may have a land 843 that travels in a groove 841 of the cone assembly 810, using the land 843 and groove 841 as a guiding feature. Upward travel of the upper seat segments 820 is controlled by an annular shoulder 849 of the cone assembly 810, such that when the upper rims 821 of the upper seat segments 320 reach the shoulder 849, the seat assembly 850 is fully expanded, as depicted in FIG. 8C.

The upper seat segments 310, in accordance with example implementations, are slidably linked to the lower seat segments 320 so that travel of the segments 310 and 320 is guided during setting. In this manner, as depicted in the example of FIG. 8B, the upper seat segments 310 include grooves 830 that engage corresponding lands of adjacent lower seat segments 320. Due to of the transmission of forces through the side wall contacts of the segments 310 and 320 (such as at reference numeral 819 in FIG. 8A), upward movement of the lower seat segments 320 also produces upward forces on the upper seat segments 310. It is noted that the segments 310 and 320 have complementary matching side angles to allow continuous contact among the segments 310 and 320 during the entire setting process.

Thus, by pulling up on the mandrel 815, radial and axial forces are produced on the upper 310 and lower 320 seat segments to expand the segmented seat assembly 850. In accordance with example implementations, the upper forces on the mandrel 815 may be produced by a downhole actuator or through upward movement of a string that is connected to the mandrel 815.

The conical surfaces 820 and 824 of the cone assembly 810 are associated with different angles for the example implementation of FIG. 8B. In this regard, in accordance with example implementations, the lower conical section 820 has a conical angle (called "$\alpha_1$" herein), with respect to a longitudinal axis 801 of the setting tool 800; and the upper conical surface 824 has a slightly smaller conical angle (called "$\alpha_2$" herein) with respect to the longitudinal axis 801. In accordance with example implementations, the $\alpha_1$ and $\alpha_2$ angles may be 15 and 7.5 degrees, respectively.

In general, in accordance with example implementations, the $\alpha_1$ angle is greater than the $\alpha$2 angle; and in accordance with example implementations, the $\alpha_1$ angle may be less than or greater than $2 \cdot \alpha_2$ FIG. 8C depicts the seat assembly 850 in the fully set position, a position at which the upper 310 and lower 320 seat segments engage a shoulder 811 of the cone assembly 810, which limits the upward travel of the segments 310 and 320. The now formed seat with multiple upper 310 and lower 320 segments may then either be released in the tubing string 20, separated from the setting tool, as depicted in FIG. 6, or may be kept as integral part of setting tool, as depicted in FIG. 8C. This will depend on further operations with or without an untethered object.

Figure 9:
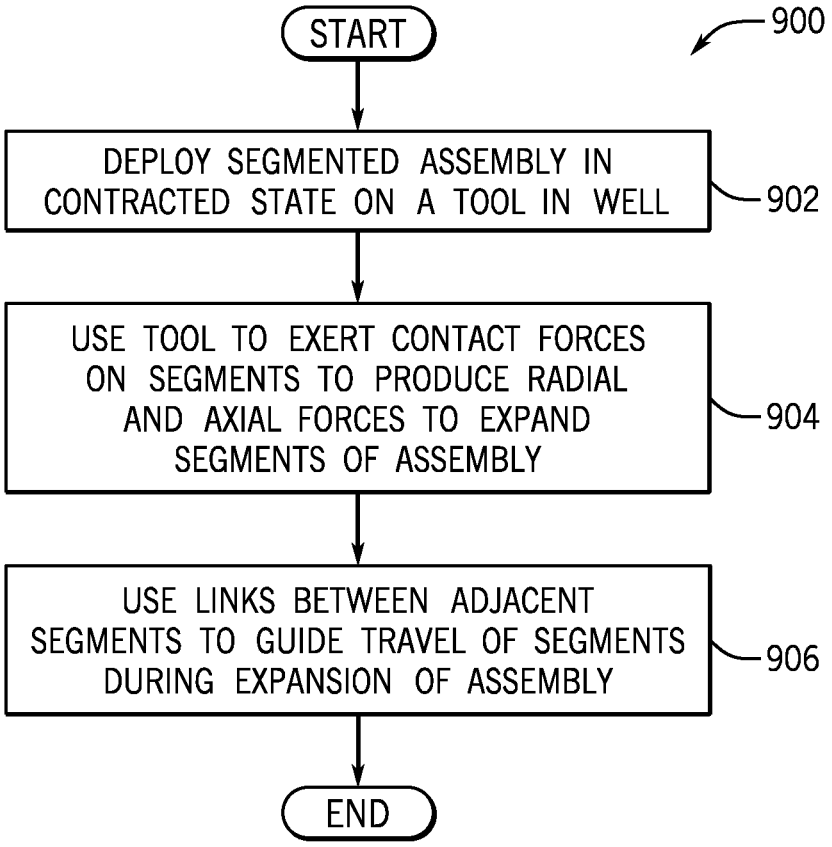
FIG. 9 is a flow diagram depicting a technique to use a tool to set a segmented seat assembly that has interlinked seat segments according to an example implementation.

Thus, referring to FIG. 9, in accordance with example implementations, a technique 900 includes deploying (block 902) a segmented seat assembly in a contracted state on a tool in a well and using (block 904) the tool to exert radial and axial forces on segments of the assembly for purposes of expanding, or setting, the assembly. Pursuant to the technique 900, links between adjacent segments of the seat assembly are used (block 906) to guide the segments during the expansion of the seat assembly.

In accordance with further example implementations, the elements of the seat assembly are not linked directly together, but rather, the seat segments are linked to intermediary linkage elements, which are guided by the setting tool. More specifically, referring to FIG. 10A, in accordance with further example implementations, a setting tool 1000 is used in conjunction with a segmented seat assembly 1050, which includes upper 310 and lower 320 segments. The setting tool 1000 includes a tubular member, or string 1010, through which a moveable rod 1012 extends for purposes of expanding the seat assembly 1050.

Figure 10A:
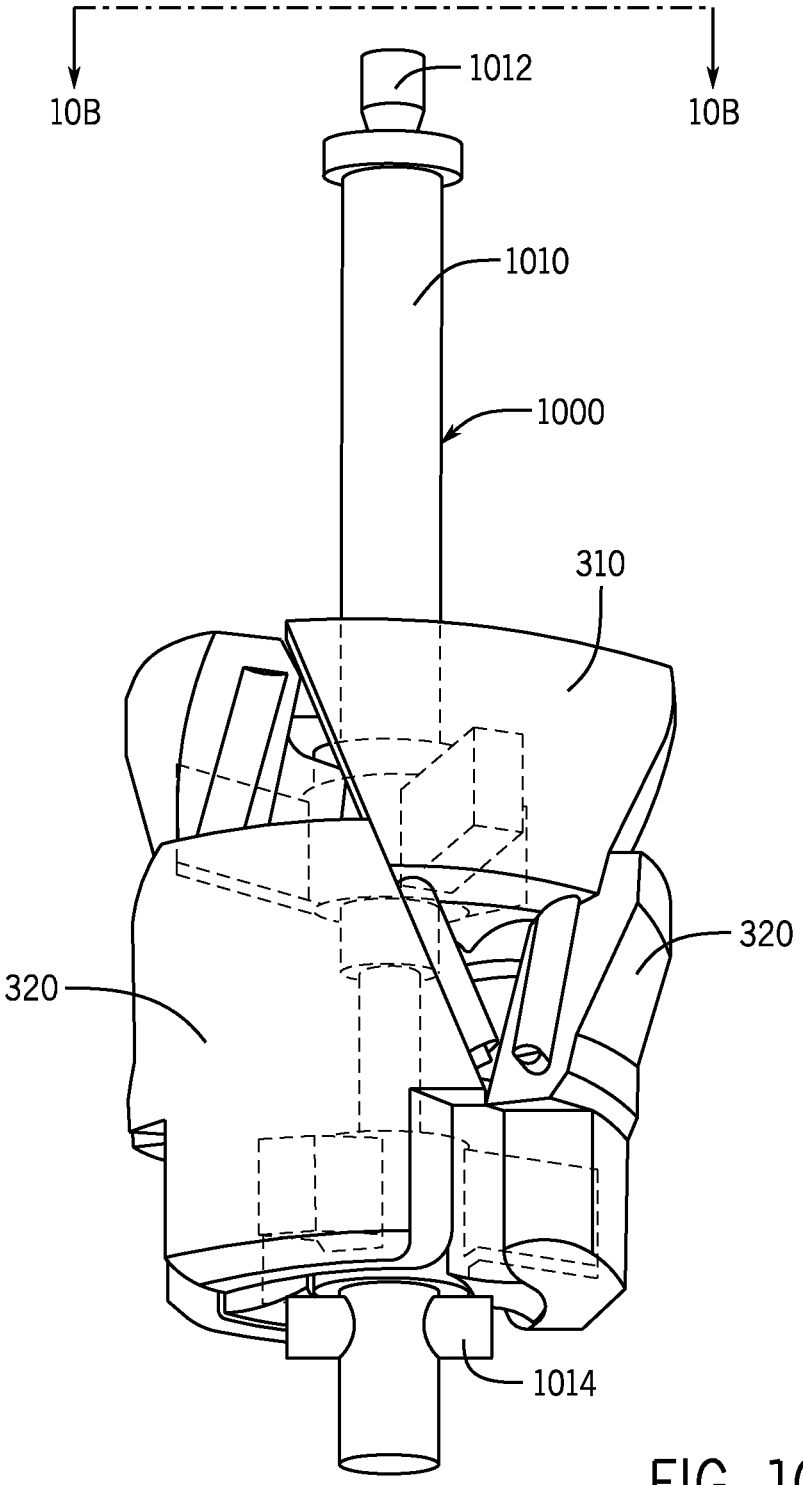
FIG. 10A is a perspective schematic view of a segmented seat assembly and a setting tool that are linked together illustrating running of the seat assembly into the well according to an example implementation.
Figure 10B:
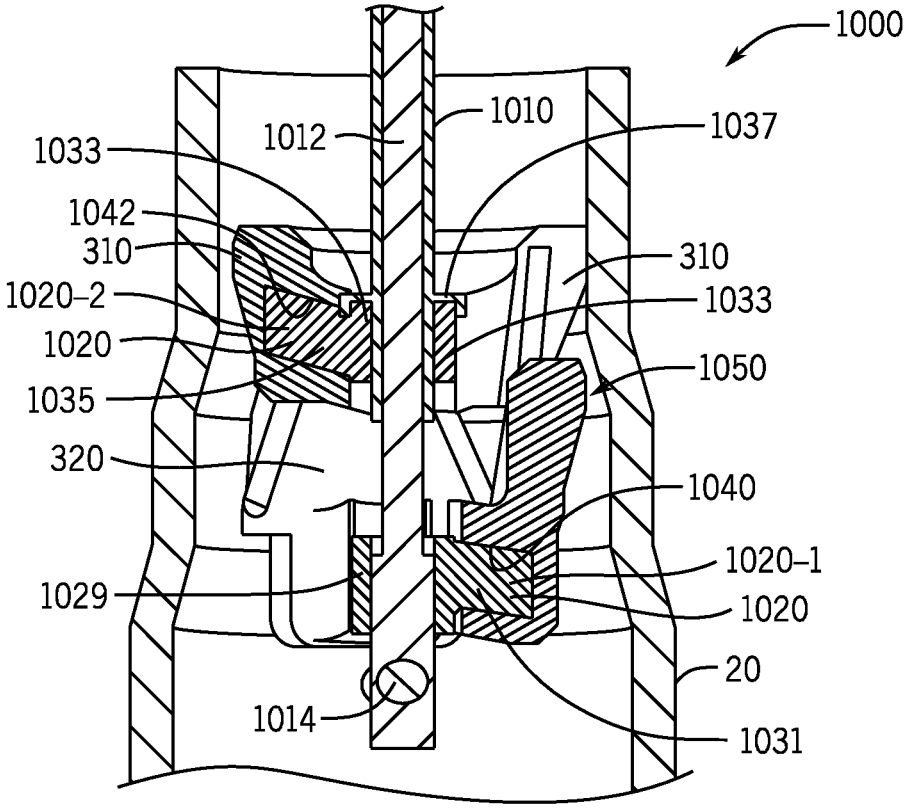
FIG. 10B is a cross-sectional view taken along line 10B-10B of FIG. 10A illustrating location of the assembly tool and seat assembly in a tubular string according to an example implementation.

FIG. 10A depicts the seat assembly 1000 in its constructed, run-in-hole position. Referring to FIG. 10B, in conjunction with FIG. 10A, for purposes of setting the seat assembly 1050, the string 1010, being part of the setting tool, is secured to the tubing string 20. As shown in FIG. 10B, for this example implementation, rigid linkage elements 1020 circumscribe the string leg 1010 and radially into the upper 310 and lower 320 seat segments rod 1012: lower linkage element 1020-1 (see also FIG. 10E) has legs 1031 that extend from a central hub 1029 (that surrounds string 1010) into the lower seat segments 320; and upper linkage element 1020-2 (see also FIG. 10F) has legs 1033 that extend from a central hub 1033 (that surrounds string 1010) into the upper seat segments 310.

Figure 10C:
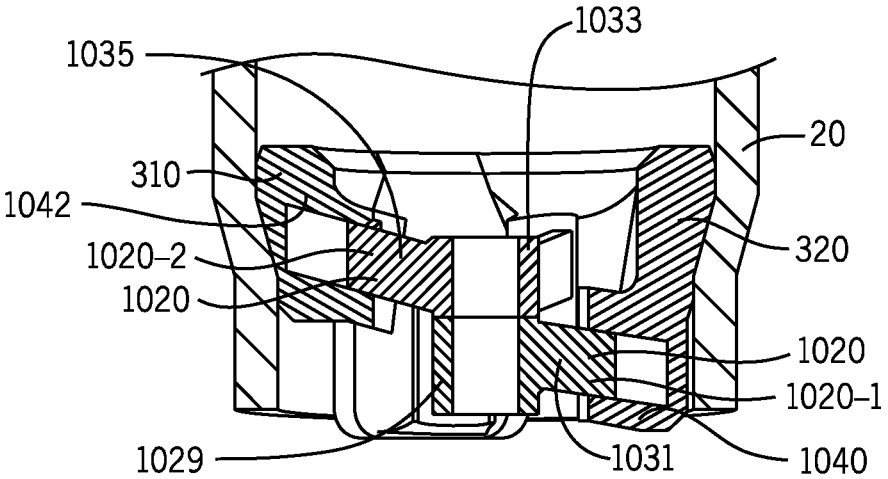
FIG. 10C is a cross-sectional view illustrating the seat assembly in an expanded state according to an example implementation.
Figure 10D:
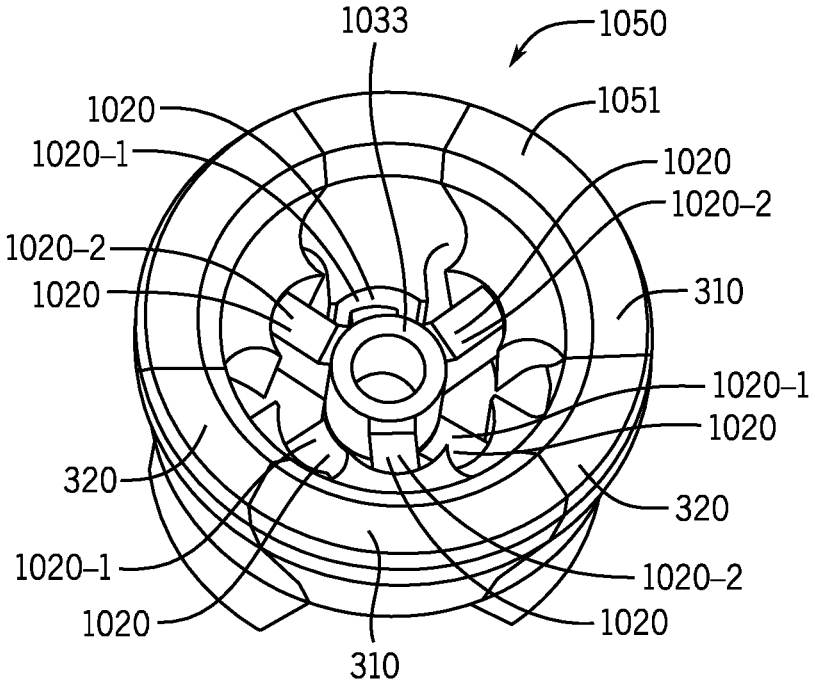
FIG. 10D is a perspective view of the seat assembly in an expanded state when set according to an example implementation.
Figure 10E:
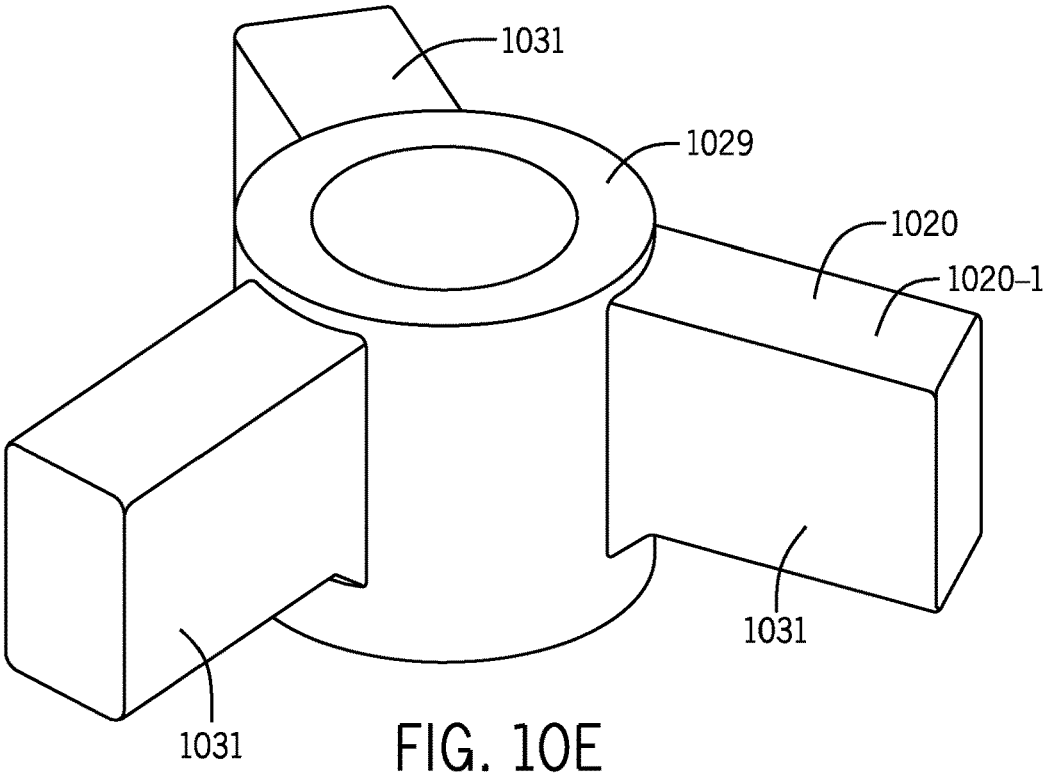
FIG. 10E is a perspective view of a lower linkage element of the setting tool of FIG. 10A according to an example implementation.
Figure 10F:
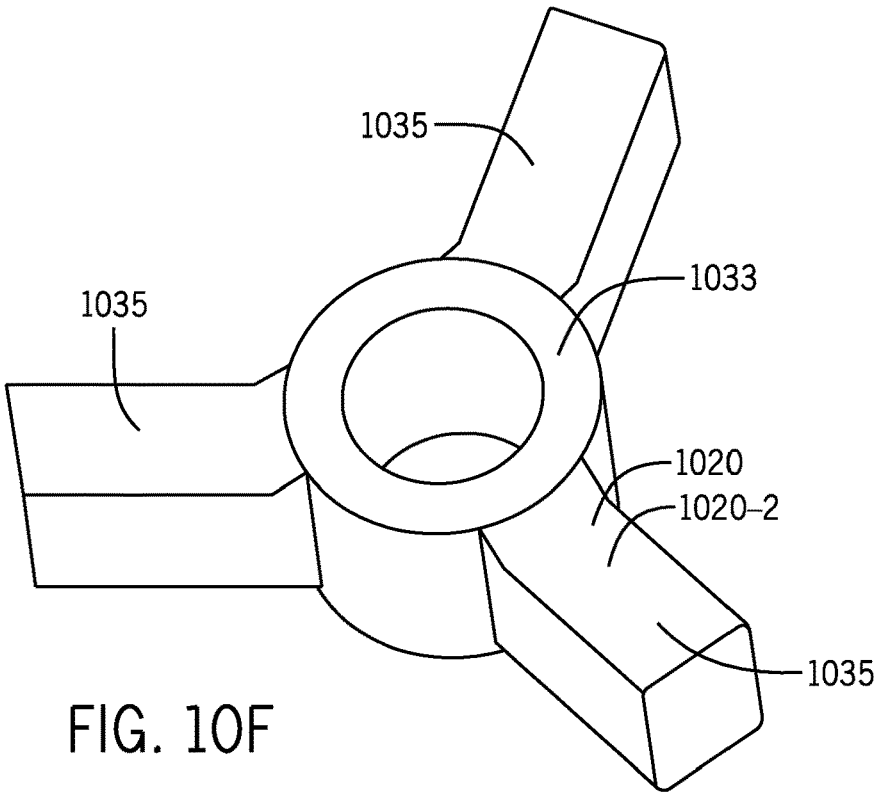
FIG. 10F is a perspective view of an upper linkage element of the setting tool of FIG. 10A according to an example implementation.

For the specific example implementation that is depicted in FIGS. 10A, 10E and 10F, the lower linkage element 1020-1 (FIG. 10E) has three legs 1031 that extend into three respective lower seat segments 320; and the upper linkage element 1020-2 (FIG. 10F) has three legs 1035 that extend into three respective upper seat segments 310. The legs of the linkage elements 1020-1 and 1020-2 extend into corresponding slots of the seat segments 310 and 320.

As depicted in FIGS. 10A, 10E and 10F, the legs 1031 and 1035 extend at angles relative to the radial plane that is perpendicular to well/tubing axis. The legs 1031 of the lower linkage element 1020-1 extend downwardly (for the orientation depicted in the figures), and the legs 1035 of the upper linkage element 1020-2 extend upwardly (for the orientation depicted in the figures). As depicted in FIGS. 10B, the legs 1031 of the lower linkage element 1020-1 extend into corresponding slots 1040 (one slot 1040 per lower seat segment 320) of the seat segments 320; and the legs 1035 of the upper linkage element 1020-2 extend into corresponding slots 1042 (one slot 1042 per upper seat segment 310) of the seat segments 310. The inclined angles at which the legs 1031 and 1035 extend reduce friction between the legs 1031 and 1035 and the slots 1040 and 1042 when the combined axial and radial movement occur during the seat setting process.

Figure 10G:
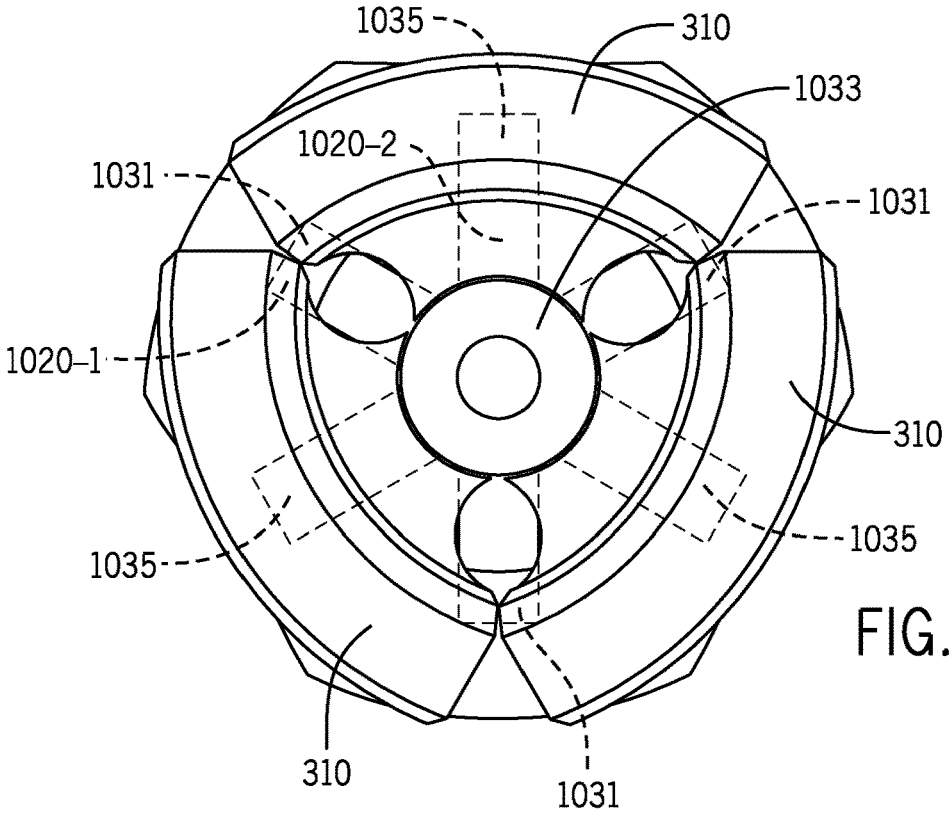
FIG. 10G is a top view of the seat assembly and setting tool of FIG. 10A according to an example implementation.
Figure 10H:
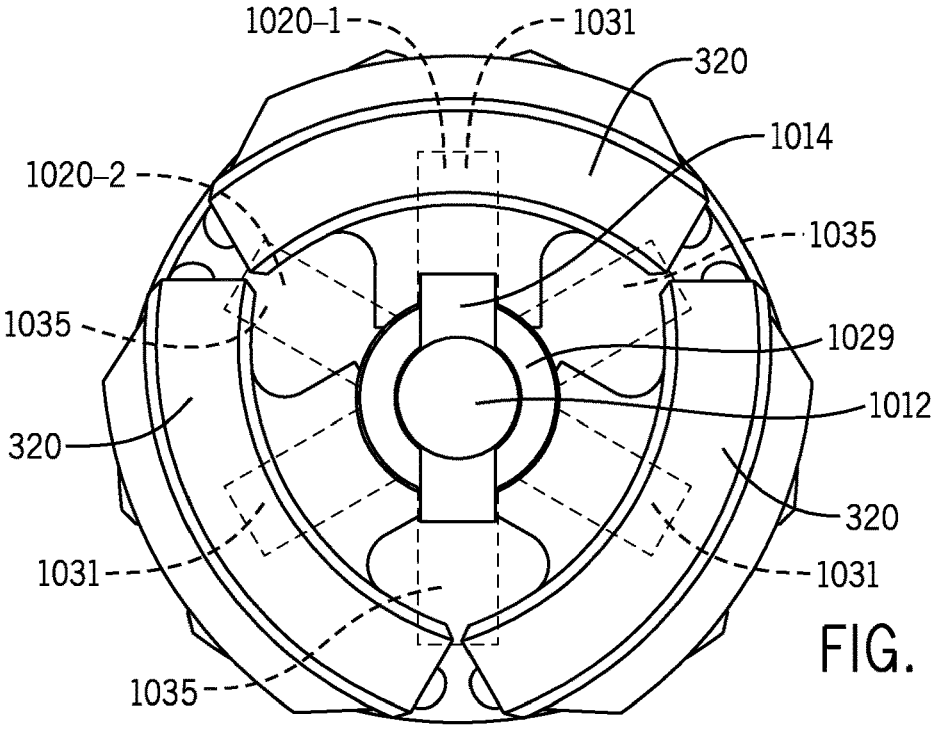
FIG. 10H is a bottom view of the seat assembly and setting tool of FIG. 10A according to an example implementation.

More specifically, referring to FIG. 10B, axially forces may be transmitted to the linkage elements 1020-1 and 1020-2 due to an upper stop 1037, which is built into the string 1010 and a lower temporary stop, which is created by a shear pin 1014 that extends through the rod 1012. In the run-in-hole state of the setting tool, the linkages 1020-1 and 1020-2 are spaced apart, as depicted in FIG. 10B. The upper and bottom views of the setting tool and seat assembly in its run-in-hole state are depicted in FIGS. 10G and 10H, respectively. To set the seat assembly, the rod 1012 is moved upwardly, which brings the upper 310 and lower 320 seat segments axially closer together (as depicted in FIG. 10C) and radially expands the segments 310 and 320.

This combined axial and radial movement of the segments ends when the desired axial and radial displacement is achieved, resulting in a continuous ring between the upper and lower group of segments. When final seat stage is achieved, the shear pin 1014 shears, therefore allowing the rod 1012 to pass through the linkage elements 1020-1 and 1020-2 and further allowing the rod 1012 and string 1010 (i.e., the setting tool adapters) to be retrieved, thereby leaving the seat formed inside the well. As depicted in FIG. 10C, the seat may be secured on a wall restriction of the tubing string 20, or if equipped with slips on the external wall (in accordance with further example implementations) the seat may be secured and locked in place inside the tubing string 20 in its expanded stage, as described in patent application Ser. No. 14/269,304.

Referring to FIG. 10D, in accordance with example implementations, the upper linkages 1020-2 and upper central hub 1033 form the central portion of an object catching seat of the seat assembly 1050; and the segments 310 and 320 form a continuous outer ring 1051 of the seat. Moreover, in accordance with example implementations, the linkage elements 1020-1 and 1020-2 may be constructed from a degradable or dissolvable material, such that after being exposed to, for example, downhole well fluids, the linkage elements 1020-1 and 1020-2 dissolve, thereby reopening fluid communication through the tubing string 20. Thus, the object catching seat may remain in place for a limited time (for a certain number of days, or weeks, depending on the composition of the linkage elements 1020) to perform a certain downhole function and thereafter be removed. As an example, the linkage elements 1020 may be constructed from an alloy, similar to one or more the alloys that are disclosed in the following patents, which have an assignee in common with the present application and are hereby incorporated by reference: U.S. Pat. No. 7,775,279, entitled, "DEBRIS-FREE PERFORATING APPARATUS AND TECHNIQUE," which issued on Aug. 17, 2010; and U.S.

Pat. No. 8,211,247, entitled, "DEGRADABLE COMPOSITIONS, APPARATUS COMPOSITIONS COMPRISING SAME, AND METHOD OF USE," which issued on Jul. 3, 2012.

In accordance with example implementations, the upper 310 and lower 320 seat segments may also be constructed from such dissolvable or degradable materials. Thus, in accordance with example implementations, the upper seat segments 310, lower seat segments 320, and linkage elements 1020 may all be constructed from dissolvable or degradable materials to effectively remove the entire assembly after the assembly has been used to perform the desired downhole function(s).

In further example implementations, the seat segments are linked to the setting tool using leaf springs as linkage elements. More specifically, referring to FIG. 11A, in accordance with example implementations, a setting tool 1100 includes a mandrel 1104 and a body 1106, which is constructed to be secured to the tubing string 20 when a segmented seat assembly 1150 is to be set. The mandrel 1104 extends through a central passageway of the body 1106 and is constructed to axially move relative to the body 1106 for purposes of setting a segmented seat assembly 1150. As described below, the radially and axially directed setting forces are produced using conical surfaces of the body 1106 and mandrel 1104.

For this example implementation, leaf springs extend between individual seat segments and the body 1106 for purposes of forming linkages between the setting tool 1100 and the segmented seat assembly 1150 to set the assembly 1150. More particularly, leaf springs 1120 extend between the body 1106 and the upper seat segments 310. For each upper seat segment 310, the lower end of an associated leaf spring 1120 is secured to the segment 310, and the upper end of the leaf spring 1120 is secured to the cone assembly 1106, while allowing a relative longitudinal sliding movement between 1120 and 1106, though a sliding groove passage. In a similar manner, slightly longer leaf springs 1122 extend between the cone assembly 1106 and associated lower seat segments 320, in accordance with example implementations.

Figure 11A:
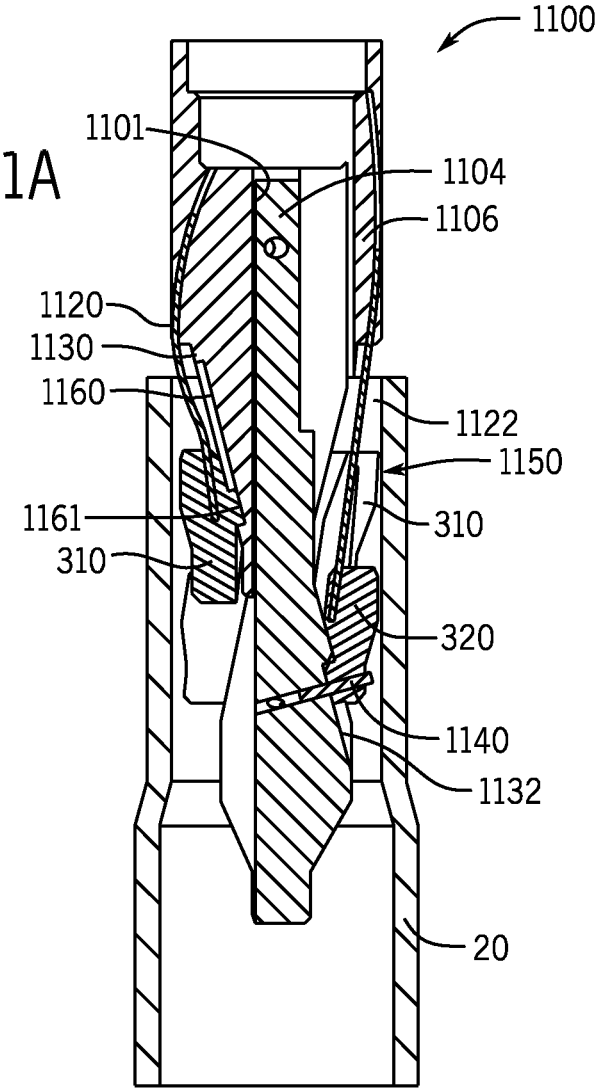
FIG. 11A is a cross-sectional view of a segmented seat assembly and a setting tool that are linked together illustrating running of the seat assembly into the well according to a further example implementation.

Conical surfaces of the body 1106 and mandrel 1104 contact inner surfaces of the segments 310 and 320 of the seat assembly 1150 to produce radially and axially directed forces on the segments 310 and 320 when the mandrel 1104 is pulled axially upward relative to the body 1106. In this regard, the mandrel 1104 includes a lower, upwardly facing conical section 1132, which exerts forces against the inner faces of the lower seat segments 320 for purposes of producing upwardly directed axial forces and outwardly directed radial forces against the segments 320 when the mandrel 1104 is pulled upwardly relative to the body 1106. As shown in FIG. 11A, one or more shear pins 1140 may secure the lower seat segments 320 to the mandrel 1104 as the segmented seat assembly 1150 and tool 1100 are run into the well to the targeted position.

Figure 11C:
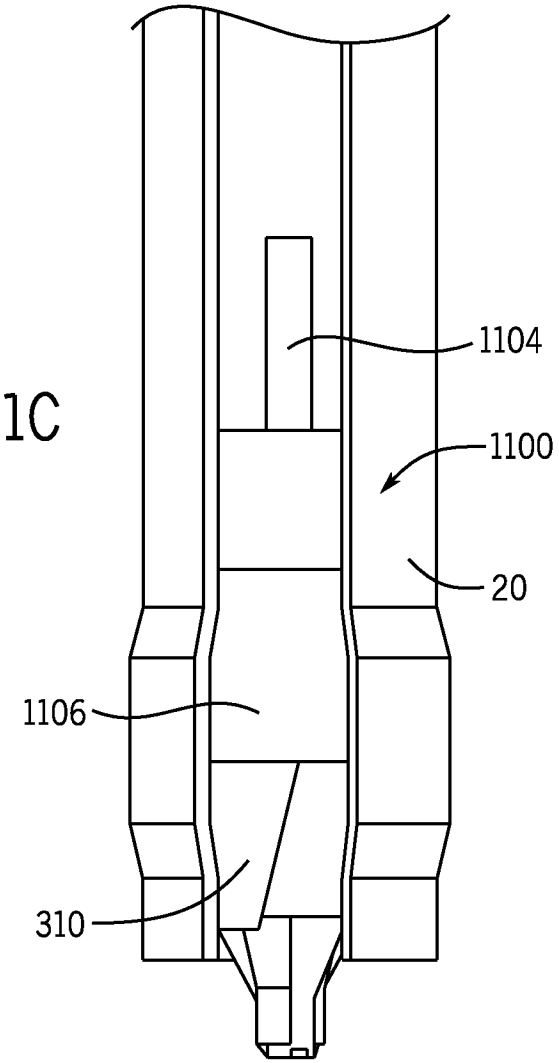
FIG. 11C is a perspective schematic view illustrating the segmented seat assembly of FIG. 11A when set according to an example implementation.
Figure 11B:
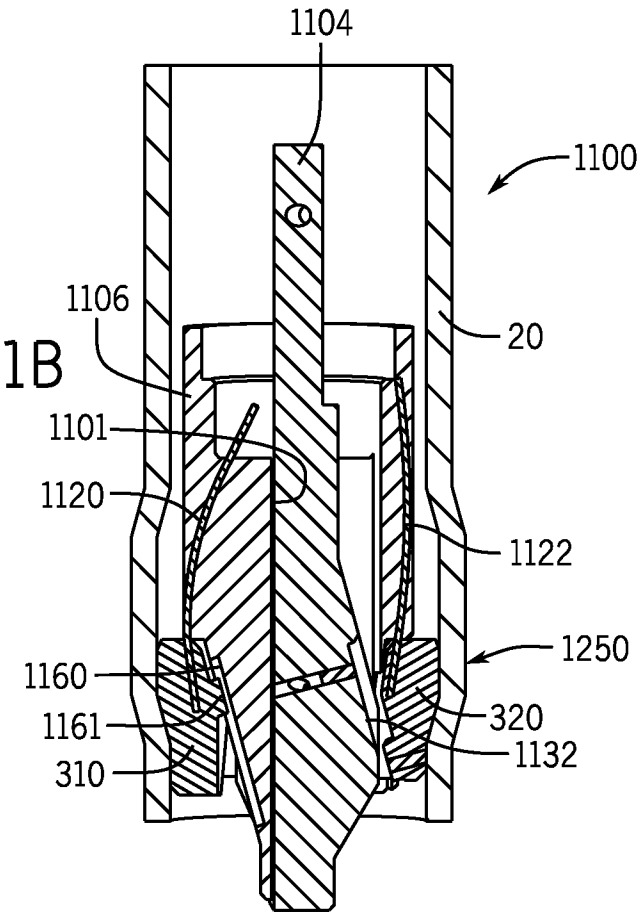
FIG. 11B is a cross-sectional view illustrating setting of the seat assembly of FIG. 11B according to an example implementation.
Figure 12:
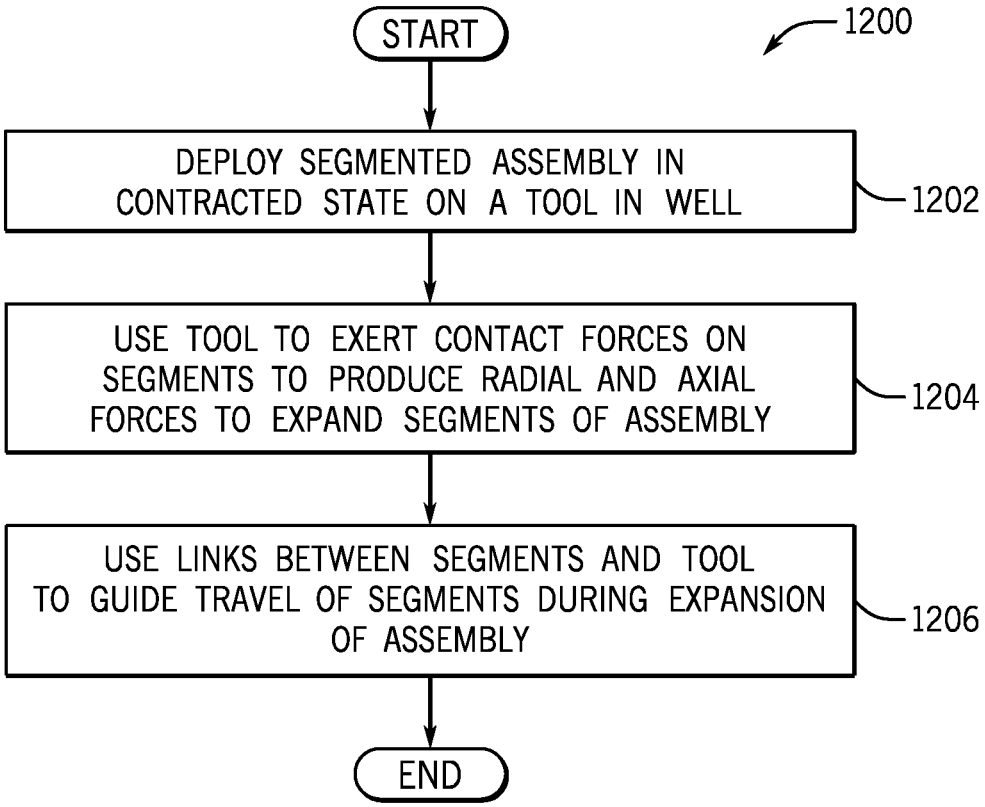
FIG. 12 is a flow diagram depicting a technique to use a setting tool to set a segmented seat assembly that is linked to the setting tool according to an example implementation.

As the mandrel 1104 is pulled upwardly during the setting of the segmented seat assembly 1150, the lower seat segments 320 exert upward forces on the upper seat segments 310. The body 1106 includes a downward facing conical surface 1130, which is constructed to exert downwardly directed axial forces and outwardly directed radial forces against the inner faces of the upper seat segments 310. These forces acting on the upper seat segments 310 force the upper seat segments 310 radially outwardly and into their final set positions to form the continuous seat with the lower seat segments 320. Respective leaf springs 1120 and 1122 are moving upwards with the upwards movement of the respective segments 320 and 310. Due to the radial flexibility of the leaf springs and axial guidance through the body 1106, the relative segments are constrained in a similar fashion: both upper and lower segments, 320 and 310, are therefore guided axially while keeping a radial expansion freedom up to reaching the final expanded stage. The seat assembly 1150 in its expanded, set state is generally depicted in FIG. 11C. In accordance with example implementations, the leaf springs 1120 and 1122 may be constructed from dissolvable or degradable materials (similar to the materials mentioned above for the seat assembly 1050, for example) for purposes of releasing the setting tool 1100 from the seat assembly 1150 after the assembly 1150 has been set.

Thus, in accordance with example implementations, a technique 1200 includes deploying (block 1202) a segmented seat assembly in a contracted state on a tool in a well and using (block 1204) the tool to exert contact forces on segments of the seat assembly to produce radial and axial forces on segments of the seat assembly for purposes of setting the seat assembly. Pursuant to the technique 1200, links between the segment and the tool are used (block 1206) to guide travel of the segments during the expansion of the seat assembly.

Other implementations are contemplated, which are within the scope of the appended claims. For example, although the segmented seat assemblies that are described herein have three upper seat segments and three lower seat segments, the segmented seat assembly may have fewer (two upper segments and two lower segments) or more seat segments (four upper segments and four lower segments, five upper segments and five lower segments, six upper segments and six lower segments, and so forth), in accordance with further implementations.

While a limited number of examples have been disclosed herein, those skilled in the art, having the benefit of this disclosure, will appreciate numerous modifications and variations therefrom. It is intended that the appended claims cover all such modifications and variations.

What is claimed is:

1. A method comprising:

deploying an assembly in a contracted state on a tool into a well, the assembly comprising segments adapted to be radially contracted in the contracted state; and expanding the assembly downhole in the well using the tool to transition the assembly between the contracted state and an expanded state, wherein expanding the assembly comprises using linkages to guide the segments during the expansion, and wherein the assembly comprises a seat assembly and expanding the assembly comprises forming an object catching surface of the seat assembly.

2. The method of claim 1, wherein expanding the assembly comprises using linkages between adjacent segments of the assembly.

3. The method of claim 2, wherein the segments define a passageway through the assembly, and expanding the assembly comprises:

moving an operator through the passageway to cause a first conical section associated with a first conical angle to contact a first set of the segments to exert radial and axial forces on the segments of the first set and cause a second conical section of the operator to contact a second set of the segments different from the first set of segments to exert radial and axial forces on the segments of the second set, wherein the second conical section is associated with a second conical angle different from the first conical angle.

4. The method of claim 1, wherein expanding the assembly comprises:

moving an operator that engages at least one of the segments.

5. The method of claim 4, wherein expanding the assembly comprises:

using the linkages to exert forces on the one or more other segments.

6. The method of claim 1, wherein deploying the assembly comprises running the tool and the assembly downhole on a string.

7. The method of claim 1, wherein using the linkages comprises using sliding engagements between adjacent segments.

8. The method of claim 1, wherein using the linkages comprises using linkages extending from the segments to the tool.

9. The method of claim 1, wherein the tool comprises a body and a mandrel, the method further comprising:

moving the mandrel relative to the body to cause a conical section of the mandrel to contact a first set of the segments and cause a conical section of the body to contact a different second set of the segments.

10. The method of claim 1, further comprising:

dissolving at least part of the linkages after the expansion.

11. The method of claim 1, wherein the assembly comprises a seat assembly, the method further comprising:

using at least part of the linkages as an object catching seat for the seat assembly.

12. A method comprising:

deploying an assembly in a contracted state on a tool into a well, the assembly comprising segments adapted to be radially contracted in the contracted state; and expanding the assembly downhole in the well using the tool to transition the assembly between the contracted state and an expanded state, wherein expanding the assembly comprises using linkages to guide the segments during the expansion, and wherein using the linkages comprises using springs extending from the segments to the tool.

13. An apparatus usable with a well, comprising:

a segmented assembly comprising segments and having a contracted state and an expanded state;

a setting tool; and linkages, wherein the setting tool is adapted to be run downhole with the assembly as a unit with the assembly being in the contracted state and be used to transition the assembly to the expanded state, and the linkages guide the segments during the transition of the assembly to the expanded state, and wherein the linkages comprise at least one spring extending between the setting tool and the segments.

14. The apparatus of claim 13, wherein the linkages comprise linkages between adjacent segments.

15. The apparatus of claim 14, wherein the setting tool comprises:

a double cone assembly comprising a first conical section associated with a first conical angle to contact a first set of the segments to exert radial and axial forces on the segments of the first set and a second conical section to contact a second set of the segments different from the first set of segments to exert radial and axial forces on the segments of the second set, wherein the second conical section is associated with a second conical angle different from the first conical angle.

16. The apparatus of claim 15, wherein the setting tool comprises a mandrel to engage at least one of the segments to move the first set and the second set of segments relative to the double cone assembly.

17. The apparatus of claim 13, wherein the setting tool comprises a moveable shaft attached to the linkages, and the linkages extend inside slots of the segments.

18. The apparatus of claim 17, wherein the assembly comprises a seat assembly, and the linkages form at least part of an object catching seat of the seat assembly.

19. An apparatus usable with a well, comprising:

a segmented seat assembly comprising segments and having a contracted state and an expanded state to form a seat;

a setting tool; and springs, wherein the setting tool is adapted to be run downhole with the seat assembly as a unit with the seat assembly being in the contracted state and be used to transition the seat assembly to the expanded state to form a seat, and the springs guide the segments during the transition of the assembly to the expanded state.

* * * * *